US007713668B2

(12) United States Patent
Moffat et al.

(10) Patent No.: US 7,713,668 B2
(45) Date of Patent: May 11, 2010

(54) TONER COMPOSITIONS

(75) Inventors: Karen A. Moffat, Brantford (CA); Emily L. Moore, Mississauga (CA); Daryl W. Vanbesien, Burlington (CA); Shigang S. Qui, Etobicoke (CA); Vladislav Skorokhod, Mississauga (CA); Edward G. Zwartz, Mississauga (CA); Juan A. Morales-Tirado, West Henrietta, NY (US); William H. Hollenbaugh, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 570 days.

(21) Appl. No.: 11/610,291

(22) Filed: Dec. 13, 2006

(65) Prior Publication Data

US 2008/0166649 A1 Jul. 10, 2008

Related U.S. Application Data

(60) Provisional application No. 60/863,580, filed on Oct. 31, 2006.

(51) Int. Cl.
*G03G 9/00* (2006.01)

(52) U.S. Cl. ..... 430/108.8; 430/109.1; 430/105; 430/137.14

(58) Field of Classification Search ..... 430/108.8, 430/109.1, 105, 137.14
See application file for complete search history.

(56) References Cited

U.S. PATENT DOCUMENTS

| | | | | |
|---|---|---|---|---|
| 6,447,974 | B1 | 9/2002 | Chen et al. | |
| 2004/0137357 | A1 | 7/2004 | Bartel et al. | |
| 2006/0121380 | A1 | 6/2006 | Skorokhod et al. | |
| 2006/0121384 | A1 * | 6/2006 | Patel et al. | 430/109.3 |

FOREIGN PATENT DOCUMENTS

| | | |
|---|---|---|
| EP | 1 681 598 | 7/2006 |
| EP | 1 739 496 | 1/2007 |

OTHER PUBLICATIONS

U.S. Appl. No. 11/272,720, filed Nov. 15, 2005 in the name of Patel et al.

* cited by examiner

*Primary Examiner*—Mark A Chapman
(74) *Attorney, Agent, or Firm*—Oliff & Berridge, PLC

(57) ABSTRACT

A toner composition having toner particles comprising a gel latex, a high Tg latex, a wax, and a colorant. The gel latex is present in an amount of from about 3 weight percent to about 30 weight percent of the toner composition, the high Tg latex is present in an amount of from about 50 weight percent to about 95 weight percent of the toner composition, the wax is present in an amount of from about 2 weight percent to about 40 weight percent of the toner composition, and the colorant is present in an amount of from about 1 weight percent to about 25 weight percent of the toner composition.

19 Claims, No Drawings

TONER COMPOSITIONS

This nonprovisional application claims the benefit of U.S. Provisional Application No. 60/863,580, filed Oct. 31, 2006.

BACKGROUND

Disclosed herein is an emulsion/aggregation toner with improved design parameters, such that the toner may exhibit lower gloss and/or an improved matte finish.

REFERENCES

U.S. Publication No. 2006-0121384 to Patel, which is incorporated herein by reference in its entirety, discloses toner compositions and processes, such as emulsion aggregation toner processes, for preparing toner compositions comprising a resin substantially free of crosslinking, a crosslinked resin, a wax and a colorant.

U.S. patent application Ser. No. 11/272,720 to Patel et al., which is incorporated herein by reference in its entirety, is directed to toner compositions and processes, such as emulsion aggregation toner processes, for preparing toner compositions comprising a high molecular weight non-crosslinked resin such as having a weight average molecular weight of at least 50,000, a wax, and a colorant.

Emulsion/aggregation (EA) toner particles are prepared by a process known in the art. Such a process includes the aggregation of various toner components from a starting latex of the components, followed by the coalescence of the particles at elevated temperature. The components incorporated into the toner are chosen to provide all the necessary requirements for the final toner particle. A colorant may be added for color, a wax may be added to provide release from the fuser roll for oil-less fuser systems, and a binder resin may be designed to provide a low minimum fusing temperature (MFT). Another key toner property which may be controlled by the components of the EA toner particles is fused image gloss. This feature is particularly important when designing EA toners for providing low gloss or matte images.

It is still desired to improve the components and design parameters of EA toner that may lower the gloss, or improve the matte finish, of printed images formed from EA toner.

SUMMARY

In embodiments, disclosed is a toner composition having toner particles comprising a gel latex, a high Tg latex, a wax, and a colorant. The gel latex is present in an amount of from about 3 weight percent to about 30 weight percent of the toner composition, the high Tg latex is present in an amount of from about 50 weight percent to about 95 weight percent of the toner composition, the wax is present in an amount of from about 2 weight percent to about 40 weight percent of the toner composition, and the colorant is present in an amount of from about 1 weight percent to about 25 weight percent of the toner composition In further embodiments, disclosed is a toner process comprising mixing gel latex, a high Tg latex, a wax and a colorant to provide toner size aggregates, heating the aggregates to form the toner, and optionally, isolating the toner, wherein the gel latex is present in an amount of from about 3 weight percent to about 30 weight percent of the toner, the high Tg latex is present in an amount of from about 50 weight percent to about 95 weight percent of the toner, the wax is present in an amount of from about 2 weight percent to about 40 weight percent of the toner, and the colorant is present in an amount of from about 1 weight percent to about 25 weight percent of the toner.

In yet further embodiments, disclosed is a method of developing an image, comprising applying a toner composition to a substrate to form an image, the toner composition comprising a gel latex, a high Tg latex, a wax, and a colorant, and fusing the toner composition to the substrate, wherein the gel latex is present in an amount of from about 3 weight percent to about 30 weight percent of the toner composition, the high Tg latex is present in an amount of from about 50 weight percent to about 95 weight percent of the toner composition, the wax is present in an amount of from about 2 weight percent to about 40 weight percent of the toner composition, and the colorant is present in an amount of from about 1 weight percent to about 25 weight percent of the toner composition.

EMBODIMENTS

The E/A toner disclosed herein comprises a wax, a high glass transition temperature (Tg) latex, a gel latex, and a colorant.

Examples of waxes suitable for use herein include aliphatic waxes such as hydrocarbon waxes having about 1 carbon atom to about 30 carbon atoms, such as from about 1 carbon atom to about 30 carbon atoms or from about 1 carbon atom to about 25 carbon atoms, polyethylene, polypropylene or mixtures thereof.

More specific examples of waxes suitable for use herein include polypropylene and polyethylene waxes commercially available from Allied Chemical and Petrolite Corporation, wax emulsions available from Michaelman Inc. and the Daniels Products Company, EPOLENE N-15™ commercially available from Eastman Chemical Products, Inc., VISCOL 550-P™, a low weight average molecular weight polypropylene available from Sanyo Kasei K.K., and similar materials. Commercially available polyethylenes possess, it is believed, a molecular weight (Mw) of about 1,000 to about 5,000, and commercially available polypropylenes are believed to possess a molecular weight of about 4,000 to about 10,000. Examples of functionalized waxes include amines, amides, for example AQUA SUPERSLIP 6550™, SUPERSLIP 6530™ available from Micro Powder Inc., fluorinated waxes, for example POLYFLUO 190™, POLYFLUO 200™, POLYFLUO 523XF™, AQUA POLYFLUO 411™, AQUA POLYSILK 19™, and POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Vax, and chlorinated polypropylenes and polyethylenes available from Allied Chemical and Petrolite Corporation and SC Johnson Wax.

In embodiments, the wax comprises a wax in the form of a dispersion comprising, for example, a wax having a particle diameter of from about 100 nanometers to about 500 nanometers, water, and an anionic surfactant. In embodiments, the wax is included in amounts such as from about 2 to about 40 weight percent. The latitude of the wax around about the centerline toner particle formulation may be about 11 weight percent±about 1 weight percent. In embodiments, the wax comprises polyethylene wax particles, such as POLYWAX 850, POLYWAX 750 and POLYWAX 655, commercially available from Baker Petrolite, having a particle diameter in the range of about 100 to about 500 nanometers.

As used herein "centerline toner particle formulation" refers to the ideal formulation of the toner particles disclosed herein. The term "latitude" refers to the variation possible in the formulation while still achieving the features associated with the centerline toner particle formulation.

The toner particles disclosed herein also include a high Tg latex.

For example, the high Tg latex comprises latex comprising monomers, such as styrene, butyl acrylate, and beta-carboxyethylacrylate (beta-CEA) monomers prepared, for example, by emulsion polymerization in the presence of an initiator, a chain transfer agent (CTA), and surfactant.

Instead of beta-CEA, the high Tg latex may include any carboxyl acid containing monomer, such as maleic acid, citraconic acid, itaconic acid, alkenyl succinic acid, fumaric acid, mesaconic acid, maleic-acid anhydride, citraconic anhydride, itaconic-acid anhydride, alkenyl succinic-acid anhydride, maleic-acid methyl half ester, maleic-acid ethyl half ester, maleic-acid butyl half ester, citraconic-acid methyl half ester, citraconic-acid ethyl half ester, citraconic-acid butyl half ester, itaconic-acid methyl half ester, alkenyl succinic-acid methyl half ester, fumaric-acid methyl half ester, half ester of the partial saturation dibasic acid such as mesaconic acid methyl half ester, dimethyl maleic acid, the partial saturation dibasic acid ester such as dimethyl fumaric acid, acrylic acid, methacrylic acid, alpha like crotonic acid, cinnamon acid, beta-partial saturation acid, crotonic-acid anhydride, cinnamon acid anhydride, alkenyl malonic acid, a monomer which has an alkenyl glutaric acid, and alkenyl adipic acids.

In embodiments, the high Tg latex comprises styrene:butyl acrylate:beta-CEA wherein, for example, the high Tg latex monomers include from about 70 weight percent to about 90 weight percent styrene, from about 10 weight percent to about 30 weight percent butyl acrylate, and from about 0.05 weight percent to about 10 weight percent beta-CEA.

In embodiments, the toner comprises high Tg latex in an amount of from about 50 weight percent to about 95 weight percent of the total weight of the toner described herein, such as 65 weight percent to about 80 of the total weight of the toner described herein. The latitude loading of the high Tg latex around about the centerline particle formulation may be about 71 weight percent±about 4 weight percent.

The high Tg latex disclosed herein that is substantially free of crosslinking and has a crosslinked density less than about 0.1 percent, such as less than about 0.05. As used herein "crosslink density" refers to the mole fraction of monomer units that are crosslinking points. For example, in a system where 1 of every 20 molecules is a divinylbenzene and 19 of every 20 molecules is a styrene, only 1 of 20 molecules would crosslink, Thus, in such a system, the crosslinked density would be 0.05.

The onset Tg (glass transition temperature) of the high Tg latex may be from about 53° C. to about 70° C., such as from about 53° C. to about 67° C. or from about 53° C. to about 65° C., or such as about 59° C.

The weight average molecular weight (Mw) of the high Tg latex may be from about 20,000 to about 60,000, such as from about 30,000 to about 40,000, or about 35,000.

The gel latex may be prepared from a high Tg latex, such as a latex comprising monomers of styrene, butyl acrylate, beta-CEA, divinylbenzene, a surfactant and an initiator. Instead of the beta-CEA, the gel latex may include a carboxyl acid containing monomer as described above. The gel latex may be prepared by emulsion polymerization.

In embodiments, the crosslinked density of the gel latex is from about 0.3 percent to about 40 percent, such as from about 0.3 percent to about 35 percent or from about 0.3 percent to about 30 percent crosslinked density.

In embodiments, the toner comprises gel latex in an amount of from about 3 weight percent to about 30 weight percent of the total weight of the toner described herein, such as 5 weight percent to about 15 of the total weight of the toner described herein. The latitude of the gel latex around about the centerline particle formulation may be about 10 weight percent±about 2 weight percent.

Other latexes suitable for preparing the high Tg latex and the gel latex include styrene acrylates, styrene methacrylates, butadienes, isoprene, acrylonitrile, acrylic acid, methacrylic acid, beta-carboxy ethyl acrylate, polyesters, known polymers such as poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly (styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acylonitrile-acrylic acid), and the like. In embodiments, the resin or polymer is a styrene/butyl acrylate/beta-carboxyethylacrylate terpolymer.

An initiator suitable for use in producing both the gel latex and the high Tg latex may be, for example, sodium, potassium or ammonium persulfate and may be present in with both the crosslinking starting monomers and non-crosslinking starting monomers in the range of from about 0.1 weight percent to about 5 weight percent, such as from about 0.3 weight percent to about 4 weight percent or from about 0.5 weight percent to about 3 weight percent of an initiator based upon the total weight of the monomers. In embodiments, the surfactant may be present in the range of from about 0.3 weight percent to about 10 weight percent, such as from about 0.5 weight percent to about 8 weight percent or from about 0.7 to about 5.0 weight percent of surfactant.

Both the gel latex and the high Tg latex may be produced by similar methods. However, in producing the high Tg latex, no divinylbenzene or similar crosslinking agent is used. Examples of crosslinking agents suitable for making, the gel latex include divinylbenzene, divinylnaphthalene, ethylene glycol diacrylate, 1,3-butylene-glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene-glycol #400 diacrylate, dipropylene glycol diacrylate, and polyoxyethylene (2)-2,2-bis(4-hydroxyphenyl)propane diacrylate. The gel latex and high Tg latex may be made by any suitable method. One example of a suitable method is described below for illustration.

First, a surfactant solution is prepared by combining a surfactant with water. Surfactants suitable for use herein may be anionic, cationic or nonionic surfactants in effective amounts of, for example, from about 0.01 to about 15, or from about 0.01 to about 5 weight percent of the reaction mixture.

Anionic surfactants include sodium dodecylsulfate (SDS), sodium dodecylbenzene sulfonate, sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like.

Examples of cationic surfactants include dialkyl benzene alkyl ammonium chloride, lauryl trimethyl ammonium chloride, alkylbenzyl methyl ammonium chloride, alkyl benzyl dim ethyl ammonium bromide, benzalkonium chloride, cetyl pyridinium bromide, $C_{12}$, $C_{15}$, $C_{17}$ trim-ethyl ammonium bromides, halide salts of quaternized polyoxyethylalkylamines, dodecyl benzyl triethyl ammonium chloride, MIRAPOL and ALKAQUAT available from Alkaril Chemical Company, SANISOL (benzalkonium chloride), available from Kao Chemicals, SANISOL B-50 available from Kao Corp., which consists primarily of benzyl dimethyl alkonium chloride, and the like.

Examples of nonionic surfactants include polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™, ANTAROX 897™, and mixtures thereof.

In a separate container, an initiator solution is prepared. Examples of initiators for the preparation of the latex include water soluble initiators, such as ammonium and potassium persulfates in suitable amounts, such as from about 0.1 to about 8 weight percent, and more specifically, in the range of from about 0.2 to about 5 weight percent. The latex includes both the initial latex and the added delayed latex wherein the delayed latex refers, for example, to the latex portion which is added to the already preformed aggregates in the size range of about 4 to about 6.5 μm, as described below.

In yet another container, a monomer emulsion is prepared by mixing the monomer components of the latex, such as styrene, butyl acrylate, beta-CEA, optionally divinylbenzene if producing the gel latex, and surfactant. In one embodiment, the styrene, butyl acrylate, and/or beta-CEA are olefinic monomers.

Once the preparation of the monomer emulsion is complete, a small portion, for example, about 0.5 to about 5 percent of the emulsion, may be slowly fed into a reactor containing the surfactant solution. The initiator solution may be then slowly added into the reactor. After about 15 to about 45 minutes, the remainder of the emulsion is added into the reactor.

After about 1 to about 2 hours, but before all of the emulsion is added to the reactor, 1-dodecanethiol or carbon tetrabromide (chain transfer agents that control/limit the length of the polymer chains) is added to the emulsion. In embodiments, the charge transfer agent may be used in effective amounts of, for example, from about 0.05 weight percent to about 15 weight percent of the starting monomers, such as from about 0.1 weight percent to about 13 weight percent or from about 0.1 weight percent to about 10 weight percent of the starting monomers. The emulsion is continued to be added into the reactor.

The monomers may be polymerized tinder starve fed conditions as referred to in U.S. Pat. No. 6,447,974, incorporated by reference herein in its entirety, to provide latex resin particles having a diameter in the range of from about 20 nanometers to about 500 nanometers, such as from about 75 nanometers to about 400 nanometers or from about 100 to about 300 nanometers.

Colorants or pigments include pigments, dyes, mixtures of pigments and dyes, mixtures of pigments, mixtures of dyes, and the like. In embodiments, the colorant comprises a pigment, a dye, mixtures thereof carbon black, magnetite, black, cyan, magenta, yellow, red, green, blue, brown, mixtures thereof, in an amount of about 1 weight percent to about 25 weight percent by weight based upon the total weight of the toner composition, such as from about 2 weight percent to about 20 weight percent or from about 5 weigh percent to about 15 weight percent based upon the total weight of the toner composition. In embodiments, the latitude of colorant around about a centerline particle formulation is about 8 weight percent±about 0.5 weight percent based upon the total weight of the toner composition. It is to be understood that other useful colorants will become readily apparent to one of skill in the art based on the present disclosure.

In general, useful colorants include Paliogeni Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700(BASF), Bon Red C (Dominion (Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Suco-Gelb 1250 (BASF), Suco-Yellow DI 355 (BASF), Suco Fast Yellow Dn 165, D 1355 and D 1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof.

Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXINVERSE LFD 4343 and LDF 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTALFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO80299, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL, YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUIASIA MAGENTA available from E.I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like or mixtures thereof. Illustrative examples of cyans include copper tetra (octadecyl sulfonamide) phthalocyanine, x-copper phthalocyanine pigment listed in the Color Index as C174160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a moonoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGI. Colored magnetites, such as mixtures of MAPICO BLACK and cyan components may also be selected as pigments.

The toner particles may be made by any known emulsion/aggregation process. An example of such a process suitable for use herein includes forming a mixture of the high Tg latex, the gel latex, wax and colorant, and deionized water in a vessel. The mixture is then stirred using a homogenizer until homogenized and then transferred to a reactor where the homogenized mixture is heated to a temperature of, for example, about 50° C. and held at such temperature for a period of time to permit aggregation of toner particles to the desired size. Once the desired size of aggregated toner particles is achieved, the pH of the mixture is adjusted in order to inhibit further toner aggregation. The toner particles are further heated to a temperature of, for example, about 90° C. and the pH lowered in order to enable the particles to coalesce and spherodize. The heater is then turned off and the reactor mixture allowed to cool to room, temperature, at which point the aggregated and coalesced toner particles are recovered and optionally washed and dried.

Dilute solutions of flocculates or aggregating agents may be used to optimize particle aggregation time with as little fouling and coarse particle formation as possible. Examples of flocculates or aggregating agents may include polyaluminum chloride (PAC), dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ (available from Alkaril Chemical Company), SANIZOL™ (benzalkonium chloride) (available from Kao Chemicals), and the like, and mixtures thereof.

In embodiments, the flocculates or aggregating agents may be used in an amount of from about 0.01 weight percent to about 10 weight percent of the toner composition, such as from about 0.02 weight percent to about 5 weight percent or from about 0.05 weight percent to about 2 weight percent. For example, the latitude of flocculates or aggregating agents around about a centerline particle formulation is about 0.17 weight percent±about 0.02 weight percent based upon the total weight of the toner composition.

The size of the formed toner particles may be from about 3 μm to about 8 μm, such as a toner particle size of from about 4.5 μm to about 7 μm or from about 5 μm to about 6 μm.

The circularity may be determined using the known Malvern Sysmex Flow Particle Image Analyzer FPIA-2100. The circularity is a measure of the particles closeness to a perfect sphere. A circularity of 1.0 identifies a particle having the shape of a perfect circular sphere. The toner particles described herein may have a circularity of from about 0.9 to about 1.0, such as from about 0.93 to about 1.0 or from about, 0.95 to about 1.0.

The developed toner mass per unit area (TMA) suitable for the printed images from the toner described herein may be in the range of from about 0.35 mg/cm$^2$ to about 0.55 mg/cm$^2$, in such as from about 0.4 mg/cm$^2$, to 0.5 about mg/cm$^2$ or from about 0.43 mg/cm$^2$ to about 0.47 mg/cm$^2$.

The onset Tg (glass transition temperature) of the toner particles may be from about 40° C. to about 65° C., such as from about 45° C. to about 60° C. or from about 50° C. to about 55° C.

The toner particles also preferably have a size such that the upper geometric standard deviation (GSDv) by volume for (D84/D50) is in the range of from about 1.15 to about 1.25, such as from about 1.18 to about 1.23. The particle diameters at which a cumulative percentage of 50% of the total toner particles are attained are defined as volume D50, which are from about 5.45 to about 5.88, such as from about 5.47 to about 5.85. The particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). The upper GSDv value for the toner particles indicates that the toner particles are made to have a very narrow particle size distribution.

It may also be desirable to control the toner particle size and limit the amount of both fine and coarse toner particles in the toner. The toner particles may have a very narrow particle size distribution with a lower number ratio geometric standard deviation (GSDn), which is express as (number D50/number D16), of from about 1.20 to about 1.30, such as from about 1.22 to about 1.29.

The toner particles disclosed herein may be suitable for use in a conductive magnetic brush development system. In embodiments, a CMB developer can be used in various systems, for example a hybrid jumping (HJD) system or a hybrid scavengeless development (HSD) system.

Embodiments described above will now be further illustrated by way of the following examples.

EXAMPLES

The following ten particle examples illustrate the latitude space covered for gel latex, wax and carbon black loading around the nominal particle formulation. The levels used in Examples 1-10 are shown below in Table 1.

Example 1L

Preparation of High Tg Latex A

A latex emulsion comprised of polymer particles generated from the emulsion polymerization of styrene, n-butyl acrylate and beta-CEA was prepared as follows. A surfactant solution consisting of about 6.37 kilograms Dowfax 2A1 (anionic emulsifier) and about 4096 kg deionized water was prepared by mixing for about 10 minutes in a stainless steel holding tank. The holding tank was then purged with nitrogen for about 5 minutes before being transferred into the reactor. The reactor was then continuously purged with nitrogen while being stirred at about 100 RPM. The reactor was then heated up to about 80° C. at a controlled rate, and held there.

Separately, about 64.5 kg of ammonium persulfate initiator was dissolved in about 359 kg of deionized water.

Separately the monomer emulsion was prepared in the following manner. About 3516.6 kg of styrene, about 787.7 kg of butyl acrylate and about 129.1 kg of beta-CEA, about 30.1 kg of 1-dodecanethiol, about 15.06 kg of decanediol diacrylate, about 85.1 kg of Dowfax 2A1 (anionic surfactant), and about 2048 kg of deionized water were mixed to form an emulsion. About 1% of the emulsion was then slowly fed into the reactor containing the aqueous surfactant phase at about 80° C. to form the "seeds" while being purged with nitrogen. The initiator solution was then slowly charged into the reactor and after about 10 minutes, the remaining emulsion was continuously fed in using a metering pump at a rate of about 0.5%/min. After about 100 minutes, approximately half of the monomer emulsion had been added to the reactor.

At this time, about 36.18 kilograms of 1-dodecanethiol was stirred into the monomer emulsion, and the emulsion was continuously fed in at a rate of about 0.5%/min. Also, at this time, the reactor stirrer was increased to about 350 RPM. Once all the monomer emulsion was charged into the main reactor, the temperature was held at about 80° C. for about an additional 2 hours to complete the reaction. Full cooling was then applied and the reactor temperature was reduced to about 35° C.

The product was collected into a holding tank. After drying the latex, the molecular properties were Mw=33,700, Mn=10,900, Mz=78,000, Mp=25,400, molecular weight distribution (MWD)=3.1, onset Tg was 58.6° C. and latex particle size=204 nanometers.

Example 2L

Preparation of High Tg Latex B

A latex emulsion comprised of polymer particles generated from the emulsion polymerization of styrene, n-butyl acrylate and beta-CEA was prepared as follows. A surfactant solution consisting of about 0.8 grams Dowfax 2A1 (anionic emulsifier) and about 514 grams deionized water was prepared by mixing for about 10 minutes in a stainless steel holding tank. The holding tank was then purged with nitrogen for about 5 minutes before being transferred into the reactor. The reactor was then continuously purged with nitrogen while being stirred at about 300 RPM. The reactor was then heated up to about 76° C. at a controlled rate, and held constant.

Separately, about 8.1 grams of ammonium persulfate initiator was dissolved in about 40 grams of deionized water.

Separately, the monomer emulsion was prepared in the following manner. About 434.2 grams of styrene, about 105.8 grams of butyl acrylate and about 16.2 grams of beta-CEA, about 3.78 grams of 1-dodecanethiol, about 1.89 grams of decanediol diacrylate, about 10.69 grams of Dowfax 2A1 (anionic surfactant), and about 257 grams of deionized water were mixed to form an emulsion. About 1% of the emulsion was then slowly fed into the reactor containing the aqueous surfactant phase at about 76° C. to form the "seeds" while being purged with nitrogen. The initiator solution was then slowly charged into the reactor and after about 20 minutes, the remaining emulsion was continuously fed in using a metering pump at a rate of about 0.5%/min. After about 100 minutes, approximately half of the monomer emulsion had been added to the reactor.

At this time, about 4.536 grams of 1-dodecanethiol was stirred into the monomer emulsion, and the emulsion was continuously fed in at a rate of about 0.5%/min. Also, at this time, the reactor stirrer was increased to about 350 RPM. Once all the monomer emulsion was charged into the main reactor, the temperature was held at about 76° C. for about an additional 2 hours to complete the reaction. Full cooling was then applied and the reactor temperature was reduced to about 35° C.

The product was collected into a holding tank. After dying the latex, the molecular properties were Mw=38,300 Mn=12,200, Mz=90,200, Mp=29,600, molecular weight distribution (MWD)=3.2, onset Tg was 57.2° C. and latex particle size=206 nanometers.

Example 3L

Preparation of High Tg Latex C

A latex emulsion comprised of polymer particles generated from the emulsion polymerization of styrene, n-butyl acrylate and beta-CEA was prepared as follows. A surfactant solution consisting of about 0.8 grams Dowfax 2A1 (anionic emulsifier) and about 514 grams deionized water was prepared by mixing for about 10 minutes in a stainless steel holding tank. The holding tank was then purged with nitrogen for about 5 minutes before being transferred into the reactor. The reactor was then continuously purged with nitrogen while being stirred at about 300 RPM. The reactor was then heated up to about 76° C. at a controlled rate, and held constant.

Separately, about 8.1 grams of ammonium persulfate initiator was dissolved in about 40 grams of deionized water.

Separately, the monomer emulsion was prepared in the following manner. About 441.2 grams of styrene, about 98.8 grams of butyl acrylate and about 16.2 grams of beta-CEA, about 3.78 grams of 1-dodecanethiol, about 1.89 grams of decanediol diacrylate, about 10.69 grams of Dowfax 2A1 (anionic surfactant), and about 257 grams of deionized water were mixed to forms an emulsion. About 1% of the emulsion was then slowly fed into the reactor containing the aqueous surfactant phase at about 76° C. to form the "seeds" while being purged with nitrogen. The initiator solution was then slowly charged into the reactor and after about 20 minutes, the remaining emulsion was continuously fed in using a metering pump at a rate of about 0.5%/min, After about 100 minutes, approximately half of the monomer emulsion had been added to the reactor.

At this time, about 4.536 grams of 1-dodecanethiol was stirred into the monomer emulsion, and the emulsion was continuously fed in at a rate of about 0.5%/min. Also, at this time, the reactor stirrer was increased to about 350 RPM. Once all the monomer emulsion was charged into the main reactor, the temperature was held at about 76° C. for about an additional 2 hours to complete the reaction. Full cooling was then applied and the reactor temperature was reduced to about 35° C.

The product was collected into a holding tank. After drying the latex, the molecular properties were Mw=38,800 Mn=12,100, Mz=89,400, Mp=30,200, molecular weight distribution (MWD)=3.2, onset Tg was 59.6° C. and latex particle size=228 nanometers.

Example 4L

Preparation of High Tg Latex D

A latex emulsion comprised of polymer particles generated from the emulsion polymerization of styrene, n-butyl acrylate and beta-CEA was prepared as follows. A surfactant solution consisting of about 0.8 grams Dowfox 2A1 (anionic emulsifier) and about 514 grams deionized water was prepared by mixing for about 10 minutes in a stainless steel holding tank. The holding tank was then purged with nitrogen for about 5 minutes before being transferred into the reactor. The reactor was then continuously purged with nitrogen while being stirred at about 300 RPM. The reactor was then heated up to about 76° C. at a controlled rate, and held constant.

Separately, about 8.1 grams of ammonium persulfate initiator was dissolved in about 40 grams of deionized water.

Separately, the monomer emulsion was prepared in the following manner. About 448.2 grams of styrene, about 91.8 grams of butyl acrylate and about 16.2 grams of beta-CEA, about 3.78 grams of 1-dodecanethiol, about 1.89 grams of decanediol diacrylate, about 10.69 grams of Dowfax 2A1 (anionic surfactant), and about 257 grams of deionized water were mixed to form an emulsion. About 1% of the emulsion was then slowly fed into the reactor containing the aqueous surfactant phase at about 76° C. to form the "seeds" while being purged with nitrogen. The initiator solution was then slowly charged into the reactor and after about 20 minutes, the remaining emulsion was continuously fed in using a metering pump at a rate of about 0.5%/min. After about 100 minutes, approximately half of the monomer emulsion had been added to the reactor.

At this time, about 4.536 grams of 1-dodecanethiol was stirred into the monomer emulsion, and the emulsion was continuously fed in at a rate of about 0.5%/min. Also, at this time, the reactor stirrer was increased to about 350 RPM. Once all the monomer emulsion was charged into the main reactor, the temperature was held at about 76° C. for about an additional 2 hours to complete the reaction. Full cooling was then applied and the reactor temperature was reduced to about 35° C.

The product was collected into a holding tank, After drying the latex, the molecular properties were Mw=38,500 Mn=12,400, Mz=86,900, Mp=30,300, molecular weight distribution (MWD)=3.1, onset Tg was 61.1° C. and latex particle size=187 nanometers.

Example 1G

Preparation of Gel Latex A

A latex emulsion comprised of polymer gel particles generated from the semi-continuous emulsion polymerization of styrene, n-butyl acrylate, divinylbenzene, and beta-CEA was prepared as follows.

A surfactant solution consisting of about 10.5 kilograms Tayca surfactant (anionic emulsifier) and about 7 kilograms deionized water was prepared by mixing in a stainless steel holding tank. The holding tank was then purged with nitrogen for about 5 minutes before about 30 percent of the surfactant solution was transferred into the reactor. About an additional 437.4 kilograms of deionized was added into the reactor. The reactor was then continuously purged with nitrogen while being stirred at about 300 RPM. The reactor was then heated up to about 76° C. at a controlled rate and held constant.

In a separate container, about 3.72 kilograms of ammonium persulfate initiator was dissolved in about 39.4 kilograms of deionized water.

Also, in a second separate container, the monomer emulsion was prepared in the following manner. About 142.2 kilograms of styrene, about 76.56 kilograms of n-butyl acrylate, about 6.56 kilograms of beta-CEA, and about 2.187 kilograms of about 55% grade divinylbenzene, about 12.25 kilograms of Tayca solution (anionic surfactant), and about 236.2 kilograms of deionized water were mixed to form an emulsion. The ratio of styrene monomer to n-butyl acrylate monomer by weight was about 65 to about 35 percent.

About 1.5 percent of the above emulsion is then slowly fed into the reactor containing the aqueous surfactant phase at about 76° C. to form the "seeds" while being purged with nitrogen. The initiator solution was then slowly charged into the reactor and after about 20 minutes the rest of the emulsion was continuously fed in using metering pumps.

Once all of the monomer emulsion was charged into the main reactor, the temperature was held at about 76° C. for about an additional 2 hours to complete the reaction. Full cooling was then applied and the reactor temperature was reduced to about 35° C. The product was collected into a holding tank after filtration through a 1 micron filter bag.

After drying a portion of the latex, the onset Tg was about 41.2° C. The average particle size of the latex as measured by Microtrac was about 44 nanometers, and residual monomer as measured by Gas Chromatography as < about 50 ppm for styrene and < about 100 ppm for n-butyl acrylate.

Example 2G

Preparation of Gel Latex B

A latex emulsion comprised of polymer gel particles generated from the semi-continuous emulsion polymerization of styrene, n-butyl acrylate, divinylbenzene, and beta-CEA was prepared as follows.

A surfactant solution consisting of about 126.6 kilograms Tayca surfactant (anionic emulsifier) and about 84.4 kilograms deionized water was prepared by mixing in a stainless steel holding tank. The holding tank was then purged with nitrogen for about 5 minutes before about 30 percent of the surfactant solution was transferred into the reactor. An additional about 5149.5 kilograms of deionized water was added into the reactor. The reactor was then continuously purged with nitrogen while being stirred at about 300 RPM. The reactor was then heated up to about 76° C. at a controlled rate and held constant.

In a separate container, about 44.85 kilograms of ammonium persulfate initiator was dissolved in about 474.8 kilograms of deionized water.

Also, in a second separate container, the monomer emulsion was prepared in the following manner. About 1715.0 kilograms of styrene, about 923.45 kilograms of n-butyl acrylate, about 79.15 kilograms of beta-CEA, and about 26.384 kilograms of about 55% grade divinylbenzene, about 443.26 kilograms of Tayca solution (anionic surfactant), and about 2553.6 kilograms of deionized water were mixed to form an emulsion. The ratio of styrene monomer to n-butyl acrylate monomer by weight was about 65 to about 35 percent.

About 1.5 percent of the above emulsion was then slowly fed into the reactor containing the aqueous surfactant phase at about 76° C. to form the "seeds" while being purged with nitrogen. The initiator solution was then slowly charged into the reactor and after about 20 minutes the rest of the emulsion was continuously fed in using metering pumps.

Once all the monomer emulsion was charged into the main reactor, the temperature was held at about 76° C. for about an additional 2 hours to complete the reaction. Full cooling was then applied and the reactor temperature was reduced to about 35° C. The product was collected into a holding tank after filtration through a 1 micron filter bag.

After drying a portion of the latex the onset Tg was about 40.6° C. The average particle size of the latex as measured by Disc Centrifuge was about 49 nanometers, and residual monomer as measured by Gas Chromatography as < about 50 ppm for styrene and < about 100 ppm for n-butyl acrylate.

Example 1W

Preparation of Wax Emulsion A

About 904.8 grams of POLYWAX®725 polyethylene wax having a Mw of about 783, a Mn of about 725 and a melting point of about 104° C. purchased from Baker Petrolite and about 22.6 grams of NEOGEN RK™ anionic surfactant comprised primarily of branched sodium dodecyl benzenene sulphonate were added to about 3,016 grams of deionized water in a 1 gallon reactor and stirred at about 400 revolutions per minute.

The reactor mixture was heated to about 130° C. in order to melt the wax. The aqueous mixture containing the molten wax was then pumped through a homogenizer at about 1 liter per minute for a period of about 30 minutes with the primary homogenizing valve fully open and the secondary homogenizing partially closed such that the homogenizing pressure was about 1,000 pounds per square inch.

Then, the primary, homogenizing valve was partially closed such that the homogenizing pressure increased to about 8,000 pounds per square inch. The reactor mixture was kept at about 130° C. and circulated through the homogenizer at about 1 liter per minute for about 60 minutes. Thereafter, the homogenizer was stopped and the reactor mixture was cooled to room temperature at about 15° C. per minute and discharged into a product container.

The resulting aqueous wax emulsion was comprised of about 30.8 percent of wax, about 0.6 percent by weight of surfactant and about 68.6 percent by weight of water and had a volume average diameter of about 241 nanometers as measured with a HONEYWELL MICROTRAC® UPA150 particle size analyzer.

Example 2W

Preparation of Wax Emulsion B

About 904.8 grams of POLYWAX®655 polyethylene wax having a Mw of about 707, a Mn of about 655 and a melting point of about 99° C. purchased from Baker Petrolite and about 22.6 grams of NEOGEN RK™ anionic surfactant comprised primarily of branched sodium dodecyl benzenene sulphonate were added to about 3,016 grams of deionized water in a 1 gallon reactor and stirred at about 400 revolutions per minute.

The reactor mixture was heated to about 120° C. in order to melt the wax. The aqueous mixture containing the molten wax was then pumped through a homogenizer at about 1 liter per minute for a period of about 30 minutes with the primary homogenizing valve fully open and the secondary homogenizing partially closed such that the homogenizing pressure was about 1,000 pounds per square inch.

Then, the primary homogenizing valve was partially closed such that the homogenizing pressure increased to about 8,000 pounds per square inch. The reactor mixture was kept at about 120° C. and circulated through the homogenizer at about 1 liter per minute for about 60 minutes. Thereafter, the homogenizer was stopped and the reactor mixture was cooled to room temperature at about 15° C. per minute and discharged into a product container.

The resulting aqueous wax emulsion was comprised of about 30.8 percent of wax, about 0.6 percent by weight of surfactant and about 68.6 percent by weight of water and had a volume average diameter of about 241 nanometers as measured with a HONEYWELL MICROTRAC® UPA150 particle size analyzer.

Example 1

Preparation of Toner Particles A (7% Carbon Black, 10% Wax Emulsion A, 12% Gel Latex A)

The EA particles were prepared by mixing together about 10.583 kilograms of High Tg Latex A having a solids loading of about 41.6 weight percent, about 3.328 kilograms of Wax Emulsion A having a solids loading of about 30.8 weight percent, about 4.3883 kilograms of black pigment dispersion Cavitron PD-K24 (Regal 330) having a solids loading of about 17.1 weight percent, about 4.8 kilograms of Gel Latex A having a solids content of about 25 weight percent with about 28.041 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter.

Upon reaching about 4.8 microns, about an additional 6.891 kilograms of High Tg Latex A was added and the particles grew to the target particle size of about 5.85 to about 5.9 microns. The particle size was frozen by adjusting the reactor mixture pH to about 6.0 with about 1 molar sodium hydroxide solution.

Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence the pH was check but not adjusted.

The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C. the slurry was treated with about 4 percent sodium hydroxide solution with a pH of about 10 for about 10 minutes, followed by cooling to room temperature.

The toner of this mixture comprised about 71 percent of styrene/acrylate polymer, about 7 percent of Regal 330 pigment, about 10 percent by weight of Wax Emulsion A and about 12 percent by weight of Gel Latex A.

The particles were washed about 5 times after removal of the mother liquor followed by about 3 washes with deionized water at room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 was about 5.54 microns, GSDv of about 1.21, GSDn of about 1.27, percent fines (<4.0 microns) of about 16.9%, particle circularity of about 0.961, onset Tg of about 53.8° C., particle weight average molecular weight Mw of about 34,000, measured carbon black content of about 8.2 weight percent by TGA, and measured wax content of about 11 weight percent by DSC. Various elements were analyzed by ICP and the residual elemental content of aluminum was about 870 ppm, about 31 ppm of calcium, about 11 ppm of copper, about 10 ppm of iron, about 2.66 ppm of sodium and about 11 ppm of silicon.

Example 2

Preparation of Toner Particles B (9% Carbon Black, 12% Wax Emulsion A, 12% Gel Latex A)

EA particles were prepared by mixing together about 9.5982 kilograms of High Tg Latex A having a solids loading of about 41.6 weight percent, about 3.99351 kilograms of Wax Emulsion A having a solids loading of about 30.80 weight percent, about 5.64211 kilograms of black pigment dispersion Cavitron PD-K24 (Regal 330) having a solids loading of about 17.1 weight percent, about 4.8 kilograms of Gel Latex A having a solids content of about 25 weight percent with about 27.1762 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence the pH was checked but not adjusted. The particle shape was monitored by measuring particle circularity using the Sysmex FPIA shape analyzer.

Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to pH of about 10 for about 10 minutes followed by cooling to room temperature. The toner of this mixture comprises about 67 percent of styrene/acrylate polymer, about 9 percent of Regal 330 pigment, about 12 percent by weight of Wax Emulsion A and about 12 percent by weight of Gel Latex A.

The particles were washed about 5 times after removal of the mother liquor followed by 3 washes with deionized water at room temperature, one wash was carried out at a pH of about 4.0 at 4 about 0° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.71 microns, GSDv of about 1.21, GSDn of about 1.25, percent fines (<4.0 microns) of about 12.7%, particle circularity of about 0.957, onset Tg of about 52.6° C., particle weight average molecular weight Mw of about 33,200, measured carbon black content of about 9.2 weight percent by TGA and measured wax content of about 10 weight percent by DSC. Various elements were analyzed by ICP and the residual elemental content of aluminum was about 84 1 ppm, about 28 ppm of calcium, about 0 ppm of copper, about 0 ppm of iron, about 233 ppm of sodium and about 0 ppm of silicon.

Example 3

Preparation of Toner Particles C (8% Carbon Black, 11% Wax Emulsion A, 10% Gel Latex A)

EA particles were prepared by mixing together 10.5826 kilograms of High Tg Latex A having a solids loading of about 41.6 weight percent, about 3.66071 kilograms of Wax Emulsion A having a solids loading of about 30.80 weight percent, about 5.0152 kilograms of black pigment dispersion Cavitron PD-K24 (Regal 330) having a solids loading of about 17.1 weight percent, about 4.0 kilograms of Gel Latex A having a solids content of about 25 weight percent with about 27.9502 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, an additional 6.891 kilograms of High Tg Latex A was added and the particles grew to the target particle size of about 5.85 to about 5.9 microns. The particle size was frozen by adjusting the reactor mixture pH to about 6.0 with about 1 molar sodium hydroxide solution.

Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence the pH was checked but not adjusted.

The particle shape was monitor by measuring particle circularity using the Syssmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to a pH of about 11 for about 10 minutes followed by cooling to room temperature.

The toner of this mixture comprised about 71 percent of styrene/acrylate polymer, about 8 percent of Regal 330 pigment, about 11 percent by weight of Wax Emulsion A and about 10 percent by weight of Gel Latex A.

The particles were washed about 5 times after removal of the mother liquor followed by about 3 washes with deionized water at about room temperature, one wash was carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.71 microns GSDv of about 1.21, GSDn of about 1.26, percent fines (<4.0 microns) of about 13.2%, particle circularity of about 0.956, onset Tg of about 53.3° C., particle weight average molecular weight Mw of about 33,200, measured carbon black content of about 9.2 weight percent by TGA and measured wax content of about 10 weight percent by DSC. Various elementals were analyzed by ICP and the residual elemental content of aluminum was about 849 ppm, about 24 ppm of calcium, about 0 ppm of copper, about 0 ppm of iron, about 212 ppm of sodium and about 15 ppm of silicon.

Example 4

Preparation of Toner Particles D (8% carbon black, 11% Wax Emulsion A, 10% Gel Latex A)

EA particles were prepared by mixing together about 10.5826 kilograms of High Tg Latex A having a solids loading of about 41.6 weight percent, about 3.660711 kilograms of Wax Emulsion A having a solids loading of about 30.80 weight percent, about 5.0152 kilograms of black pigment dispersion Cavitron PD-K24 (Regal 330) having a solids loading of about 17.1 weight percent, about 4.0 kilograms of Gel Latex A having a solids content of about 25 weight percent with about 27.9502 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.90 microns.

The particle size was frozen by adjusting the reactor mixture pH to about 6.0 with 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles are cooled at a control rate of about 0.6° C. per minute to about 85° C. and then fast cooled to about 63° C. At about 63° C., the slurry was treated with about 4 percent sodium hydroxide solution to a pH of about 10 for about 10 minutes followed by cooling to room temperature.

The toner of this mixture comprised about 71 percent of styrene/acrylate polymer, about 8 percent of Regal 330 pigment, about 11 percent by weight of Wax Emulsion A and about 10 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.83 microns, GSDv of about 1.22, GSDn of about 1.26, percent fines (<4.0 microns) of about 13.0%, particle circularity of about 0.962, onset Tg of about 52.7° C., particle weight average molecular weight Mw of about 34,100, measured carbon black content of about 9.0 weight percent by TGA and measured wax content of about 9.0 weight percent by DSC. Various elementals were analyzed by ICP and the residual elemental content of aluminum was about 705 ppm, about 28 ppm of calcium, about 1 ppm of copper, about 10 ppm of iron, about 220 ppm of sodium and about 4 ppm of silicon.

Example 5

Preparation of Toner Particles E (7% Carbon Black, 12% Wax Emulsion A, 12% Gel Latex A)

EA particles were prepared by mixing together 10.0904 kilograms of High Tg Latex A having a solids loading of about 41.6 weight percent, about 3.99351 kilograms of Wax Emulsion A having a solids loading of about 30.80 weight percent, about 4.3883 kilograms of black pigment dispersion Cavitron PD-K24 (Regal 330) having a solids loading of about 17.1 weight percent, about 4.8 kilograms of Gel Latex A having a solids content of about 25 weight percent with about 27.869 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron, as measured with a Coulter Counter. Upon reaching about 4.8 microns, about an additional 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C., per minute.

At the start of particle coalescence the pH was checked but not adjusted. The particle shape was monitored by measuring particle circularity using the Sysmex FPIA shape analyzer. Once the target circularity or about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to a pH of about 10 for about 10 minutes, followed by cooling to about room temperature.

The toner of this mixture comprised about 69 percent of styrene/acrylate polymer, about 7 percent of Regal 330 pigment, about 12 percent by weight of Wax Emulsion A and about 12 percent by weight of Gel Latex A.

The particles were washed about 5 times after removal of the mother liquor followed by about 3 washes with deionized water at room temperature, one wash carried out at a ply of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.83 microns, (GSDv of about 1.21, GSDn of about 1.26, percent fines (<4.0 microns) of about 12.2%, particle circularity of about 0.960, onset Tg of about 51.8° C., particle weight average molecular weight Mw of about 31,600, measured carbon black content of about 8.1 weight percent by TGA and measured wax content of about 10 weight percent by DSC. Various elementals were analyzed by ICP and the residual elemental content of aluminum was about 811 ppm, about 25 ppm of calcium, about 162 ppm of copper, about 4 ppm of iron, about 222 ppm of sodium and about 0 ppm of silicon.

Example 6

Preparation of Toner Particles F (9% Carbon Black, 10% Wax Emulsion A, 8% Gel Latex A)

EA particles were prepared by mixing together about 11.0748 kilograms of High Tg Latex A having a solids loading of about 41.6 weight percent, about 3.32792 kilograms of Wax Emulsion A having a solids loading of about 30.80 weight percent, about 5.64211 kilograms of black pigment dispersion Cavitron PD-K24 (Regal 330) having a solids loading of about 17.1 weight percent, about 3.2 kilograms of Gel Latex A having a solids content of about 25 weight percent with about 28.0315 kilograms of deionized water in a vessel while being stirred using an IKA Ultra Turrax® T50 homogenizer operating at about 4,000 rpm.

After about 5 minutes of homogenizing, slow controlled addition of about 1.7° kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture ph to about 3,9 with about 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with 4 percent sodium hydroxide solution to a pH of about 10 for 10 minutes, followed by cooling to about room temperature.

The toner of this mixture comprised about 73 percent of styrene/acrylate polymer, about 9 percent of Regal 330 pigment, about 10 percent by weight of Wax Emulsion A and about 8 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.83 microns, GSD by volume of about 1.21, GSD by number of about 1.27, percent fines (<4.0 microns) of about 12.2%, particle circularity of about 0.959, onset Tg of about 52.0° C., particle weight average molecular weight Mw of about 31,600, measured carbon black content of about 8.1 weight percent by TGA and measured wax content of about 10 weight percent by DSC. Various elementals were analyzed by ICP and the residual elemental content of aluminum was about 817 ppm, about 32 ppm of calcium, about 13 ppm of copper, about 24 ppm of iron, about 11 ppm of sodium and about 99 ppm of silicon.

Example 7

Preparation of Toner Particles G (7% Carbon Black, 12% Wax Emulsion, 8% Gel Latex A)

EA particles were prepared by mixing together about 11.0748 kilograms of High Tg Latex A having a solids loading of about 41.6 weight percent, about 3.99351 kilograms of Wax Emulsion A having a solids loading of about 30.80 weight percent, about 4.3883 kilograms of black pigment dispersion Cavitron PD-K24 (Regal 330) having a solids loading of about 17.1 weight percent, about 3.2 kilograms of Gel Latex A having a solids content of about 25 weight percent with about 28.5525 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture pH to about 3.9 with 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to a pH of about 10 for about 10 minutes followed by cooling to room temperature.

The toner of this mixture comprised about 73 percent of styrene/acrylate polymer, about 7 percent of Regal 330 pigment, about 12 percent by weight of Wax Emulsion A and about 8 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet diver, the final volume median particle size D50 of about 5.77 microns, GSDv of about 1.23, GSDn of about 1.27, percent fines (<4.0 microns) of about 14.4%, particle circularity of about 0.959, onset Tg of about 54.1° C., particle weight average molecular weight Mw of about 32,000, measured carbon black content of about 8.2 weight percent by TGA and measured wax content of about 10.2 weight percent by DSC. Various elements were analyzed by ICP and the residual elemental content of aluminum was about 760 ppm, about 30 ppm of calcium, about 13 ppm of copper, about 0 ppm of iron, about 256 ppm of sodium and about 0 ppm of silicon.

Example 8

Preparation of Toner Particles H (9% Carbon Black, 12% Wax Emulsion A, 8% Gel Latex A)

EA particles were prepared by mixing together about 10.583 kilograms of High Tg Latex A having a solids loading of about 41.6 weight percent, about 3.99351 kilograms of Wax Emulsion A having a solids loading of 3 about 0.80 weight percent, about 5.64211 kilograms of black pigment dispersion Cavitron PD-K24 (Regal 330) having a solids loading of about 17.1 weight percent, about 3.2 kilograms of Gel Latex A having a solids content of about 25 weight percent with about 27.8598 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530) grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to pH of about 10 for about 10 minutes, followed by cooling to about room temperature.

The toner of this mixture comprised about 71 percent of styrene/acrylate polymer, about 9 percent of Regal 330 pigment, about 12 percent by weight of Wax Emulsion A and about 8 percent by weight of Gel Latex A.

The particles were washed about 5 times after removal of the mother liquor, followed by about 3 washes with deionized water at room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.71 microns, GSDv of about 1.21, GSDn of about 1.25, percent fines (<4.0 microns) of about 13.1%, particle circularity of about 0.962, onset Tg of about 53.5° C., particle weight average molecular weight Mw of about 34,300, measured carbon black content of about 10.0 weight percent by TGA and measured wax content of about 9,3 weight percent by DSC. Various elements were analyzed by ICP and the residual elemental content of aluminum was about 755 ppm, about 32 ppm of calcium, about 6 ppm of copper, about 5 ppm of iron, about 2-9 ppm of sodium and about 0 ppm of silicon.

Example 9

Preparation of Toner Particles I (7% Carbon Black, 10% Wax Emulsion A, 8% Gel Latex A)

EA particles were prepared by mixing together about 11.5671 kilograms of High Tg Latex A having a solids loading of about 41.6 weight percent, about 3.32792 kilograms of Wax Emulsion A having a solids loading of about 30.80 weight percent, about 4.3883 kilograms of black pigment dispersion Cavitron PD-K24 (Regal 330) having a solids loading of about 17.1 weight percent, about 3.2 kilograms of Gel Latex A having a solids content of about 25 weight percent with about 28.7242 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.891 kilograms of High Tg Latex A was added and the particles grew to the target particle size of about 5.85 to about 5.9 microns. The particle size was frozen by adjusting the reactor mixture pH to about 6.0 with about 1 molar sodium hydroxide solution. Thereafter, the reactor mixture was heated at about 0.35° C., per minute to a temperature of about 85° C., followed by adjusting the reactor mixture pH to about 3.9 with about 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C., and then fast cooled to about 63° C. At about 63° C., the slurry was treated with about 4 percent sodium hydroxide solution to pH of about 10 for about 10 minutes followed by cooling to about room temperature.

The toner of this mixture comprised about 75 percent of styrene/acrylate polymer, about 7 percent of Regal 330 pigment, about 10 percent by weight of Wax Emulsion A and about 8 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume median particle size D50 of about 5.71 microns, GSDv of about 1.22, GSDn of about 1.26, percent fines (<4.0 microns) of about 14.1%, particle circularity of about 0.964, onset Tg of about 53.3° C., particle weight average molecular weight Mw of about 31,900, measured carbon black content of about 8.1 weight percent by TGA and measured wax content of about 8.2 weight percent by DSC. Various elements were analyzed by ICP and the residual elemental content of aluminum was about 989 ppm, about 33 ppm of calcium, about 19 ppm of copper, about 10 ppm of iron, about 279 ppm of sodium and about 6 ppm of silicon.

Example 10

Preparation of Toner Particles J (9% Carbon Black, 10% Wax Emulsion A, 12% Gel Latex A)

EA particles were prepared by mixing together about 10.0904 kilograms of High Tg Latex A having a solids loading of about 41.6 weight percent, about 3.32792 kilograms of Wax Emulsion A having a solids loading of about 30.80 weight percent, about 5.64211 kilograms of black pigment dispersion Cavitron PD-K24 (Regal 330) having a solids loading of about 17.1 weight percent, about 4.8 kilograms of Gel Latex A having a solids content of about 25 weight percent with about 27.3479 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 micron, an additional about 6.891 kilograms of High Tg Latex A was added and the particles grew to the target particle size of about 5.85 to about 5.9 microns.

The particle size was frozen by adjusting the reactor mixture pH to about 6.0 with about 1 molar sodium hydroxide solution. Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles were cooled at a control rate of about 0.6° C. per minute to about 85° C. and then fast cooled to about 63° C. At about 63° C., the slurry was treated with about 4 percent sodium hydroxide solution to pH of about 10 for about 10 minutes, followed by cooling to about room temperature, The toner of this mixture comprised about 69 percent of styrene/acrylate polymer, about 9 percent of Regal 330 pigment, about 10 percent by weight of Wax Emulsion A and about 12 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature. The amount of acid used for the pH 4 wash was about 200 grams of about 0.3 molar nitric acid.

After drying the particles in an Aljet dryer, the final volume particle size D50 of about 5.65 microns, GSDv of about 1.19, GSDn of about 1.24, percent fines (<4.0 microns) of about 12.8%, particle circularity of about 0.961, onset Tg of about 50.7° C., particle weight average molecular weight Mw of about 32,400, measured carbon black content of about 9.3 weight percent by TGA and measured wax content of about 9.2 weight percent by DSC. Various elements were analyzed by ICP and the residual elemental content of aluminum was about 805 ppm, about 32 ppm of calcium, about 9 ppm of copper, about 4 ppm of iron, about 240 ppm of sodium and about 0 ppm of silicon.

TABLE 1

EA Particle Formulation Latitude Study

| Example | Pigment Loading | Wax Emulsion Loading | Gel latex A Loading |
|---|---|---|---|
| 1 | 7 | 10 | 12 |
| 2 | 9 | 12 | 12 |
| 3 | 8 | 11 | 10 |
| 4 | 8 | 11 | 10 |
| 5 | 7 | 12 | 12 |
| 6 | 9 | 10 | 8 |

TABLE 1-continued

| EA Particle Formulation Latitude Study | | | |
|---|---|---|---|
| Example | Pigment Loading | Wax Emulsion Loading | Gel latex A Loading |
| 7 | 7 | 12 | 8 |
| 8 | 9 | 12 | 8 |
| 9 | 7 | 10 | 8 |
| 10 | 9 | 10 | 12 |

The purpose of the following examples is to show how the key components in the particle formulation and the latitude in loading of these components listed above, produce an optimized EA particle and subsequent toner that when developed by CMB development and subsequently fused using either a hard fuser roll or a softer Teflon Over Silicone (TOS) fuser roll onto paper provide superior image quality matte monochrome prints. The first series of Examples 1-10 covers the particle formulation latitude space at about the nominal centerline formulation of about 8% carbon black, about 10% gel latex and about 11.0% polyethylene wax. In this series, polyethylene wax POLYWAX 725 was employed which was later replaced by a lower molecular weight polyethylene wax POLYWAX 655 at the same weight percent. The examples that cover the latitude range for POLYWAX 655 are Examples 17 to 19 where the input wax loading covered a narrower range of about 11.0+/− about 0.5 weight percent. Two other components of the toner particle are the aggregating agent poly(aluminum chloride) at the nominal loading of about 0.17 parts per hundred with a formulation latitude range from about 0.15 pph to about 0.19 pph and the resin binder component, a high glass transition (Tg) temperature latex, The nominal Tg for this latex is a Tg of about 59° C. spanning a range of from about 57° C. to about 62° C. The formulation latitude in aggregating agent PAC are provided in Examples 11 to 13 and formulation latitude in latex Tg are illustrated in Examples 14 to 16.

TABLE 2

| EA Particle Formulation Latitude Study of PAC and Latex Tg Parameters | | | |
|---|---|---|---|
| Example | PAC loading | Example | Latex Tg |
| 11 | 0.15 pph | 14 | 57° C. |
| 12 | 0.17 pph | 15 | 60° C. |
| 13 | 0.19 pph | 16 | 61° C. |

Example 11

Preparation of Toner Particles K with 0.15 pph PAC

A particles were prepared by mixing together about 190.5 grams of High Tg Latex A having a solids loading of about 41.6 weight percent, about 65.89 grams of Wax Emulsion A having a solids loading of about 30.8 weight percent and about 507.4 grams of deionized water in a vessel and stirred using an IKA Ultra Turrax® T50 homogenizer operating at about 4,000 rpm. To this mixture was added about 89.23 grams of black pigment dispersion Cavitron PD-K18 (Regal 330) having a solids loading of about 17.3 weight percent and about 72 grams of Gel Latex A having a solids content of about 25 weight percent.

After about 5 minutes of homogenizing, slow controlled addition of about 27 grams of a flocculent mixture containing about 2.7 grams poly(aluminum chloride) mixture and about 24.3 grams of about 0.02 molar nitric acid solution was performed. As the flocculent mixture was added slowly, the homogenizer speed was increased to about 5,200 rpm and homogenized for an about additional 5 minutes. Thereafter, the mixture was heated at about 1° C. per minutes to about 49° C. and the particles aggregated to a target size of about 4.8 micron as measured with a Coulter Counter. Upon reaching about 4.8 microns, about an additional 124 grams of High Tg Latex A was added and the particles grew to the target particle size of about 5.7 microns.

The particle size was frozen by adjusting the reactor mixture pH to about 6.0 with about 1 molar sodium hydroxide solution. Thereafter, the reactor mixture was heated at about 1° C. per minute to a temperature of about 85° C., followed by adjusting the reactor mixture pH to about 3.9 with about 0.3 M nitric acid solution. The reaction mixture was then ramped to about 96° C. at about 0.5° C. per minute.

At the start of particle coalescence the pH was checked but not adjusted. The particle shape was monitored by measuring particle circularity using the Sysmex FPIA shape analyzer. Once the target circularity was about 0.958 achieved, the pH was adjusted to about 7.0 with about 1 percent sodium hydroxide solution. Particle coalescence was continued for a total of about 5 hours at about 96° C. The particles are cooled at a control rate of about 0.6° C. per minute to about 85° C. and then fast cooled to about 63° C. At about 63° C. the slurry, was treated with about 4 percent sodium hydroxide solution to pH of about 10 for about 10 minutes followed by cooling to about room temperature.

The toner of this mixture comprised about 71 percent of styrene/acrylate polymer, about 8 percent of Regal 330 pigment, about 11 percent by weight of Wax Emulsion A and about 10 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature.

After drying the particles in an Aljet dryer, the final volume median particle size D50 of about 5.65 microns, GSDv of about 1.20, GSDn of about 1.23, percent fines (<4.0 microns) of about 14.51%, particle circularity of about 0.956, particle onset Tg of about 52.8° C. and measured wax content of about 9.82 weight percent by DSC. Various elements were analyzed by ICP and the residual elemental content of aluminum was about 765 ppm, about 32 ppm of calcium and less than about 5 ppm of copper.

Example 12

Preparation of Toner Particles L with 0.17 pph PAC (Nominal Level)

A toner was prepared as in toner particle example 11, except that the PAC aggregating solution was about 30.6 grams containing about 3.06 grams of poly(aluminum chloride) mixture and about 27.54 grams of about 0.02 molar nitric acid solution.

After drying the particles in an Aljet dryer, the final volume median particle size D50 of about 5.65 microns, GSDv of about 1.20, GSDn of about 1.25, percent fines (< 4.0 microns) of about 17.0%, particle circularity of about 0.965, particle onset Tg of about 53.7° C. and measured wax content of about 10.71 weight percent by DSC. Various elements were analyzed by ICP and the residual elemental content of aluminum was about 715 ppm, about 32 ppm of calcium and about less than 5 ppm of copper.

Example 13

Preparation of Toner Particles M with 0.19 pph PAC

A toner was prepared as in toner particle example 11, except that the PAC aggregating solution was about 34.2 grams containing about 3.42 grams of poly(aluminum chloride) mixture and about 30.78 grams of about 0.02 molar nitric acid solution.

After drying the particles in an Aljet dryer, the final volume median particle size D50 of about 5.77 microns, GSDv of about 1.20, GSDn of about 1.23, percent fines (< 4.0 microns) of about 12.93%, particle circularity of about 0.964, particle onset Tg of about 52.7° C. and measured wax content of about 9.71 weight percent by DSC. Various elements were analyzed by ICP and the residual elemental content of aluminum was about 953 ppm, about 36 ppm of calcium and about less than 5 ppm of copper.

Example 14

Preparation of Toner Particles N—Latex Series Tg=57.2° C.

EA particles were prepared by mixing together about 183.4 grams of High Tg Latex B having a solids loading of about 43.2 weight percent and a glass transition temperature of about 57.2° C., about 65.89 grams of Wax Emulsion A having a solids loading of about 30.80 weight percent, about 90.27 grams of black pigment dispersion Cavitron PD-K24 (Regal 330) having a solids loading of about 17.1 weight percent, about 72.0 grams of EA15-11 gel latex having a solids content of about 25 weight percent with about 510.2 grams of deionized water in a vessel while being stirred using an A, Ultra Turrax® T50 homogenizer operating at about 4,000 rpm.

After about 5 minutes of homogenizing, slow controlled addition of about 30.6 grams of a flocculent mixture containing about 3.06 grams poly(aluminum chloride) mixture and about 27.54 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 119.44 grams of SQ114L latex High Tg Latex B was added and the particles grew to the target particle size of about 5.85 to about 5.90 microns. The particle size was frozen by adjusting the reactor mixture pH to about 6.0 with about 1 molar sodium hydroxide solution. Thereafter, the reactor mixture was heated at about 1° C. per minute to a temperature of about 85° C., followed by adjusting the reactor mixture pH to about 3.9 with about 0.3 M, nitric acid solution.

The reaction mixture was then ramped to about 96° C. at about 0.5° C. per minute. At the start of particle coalescence the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles are cooled at a control rate of about 0.6° C. per minute to about 85° C. and then fast cooled to about 63° C. At about 63° C., the slurry was treated with about 4 percent sodium hydroxide solution to pH of about 10 for about 10 minutes followed by cooling to room temperature.

The toner of this mixture comprised about 71 percent of styrene/acrylate polymer, about 8 percent of Regal 330 pigment, about 11 percent by weight of Wax Emulsion A and about 10 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature.

After drying the particles in an Aljet dryer, the final volume median particle size D50 of about 5.65 microns, GSDv of about 1.21, GSDn of about 1.24, percent fines (< 4.0 microns) of about 12.2%, particle circularity of about 0.963, particle onset Tg of about 50.7° C., particle weight average molecular weight Mw of about 35,400, measured carbon black content of about 8.8 weight percent by TGA and measured wax content of about 9.5 weight percent by DSC. Various elements were analyzed by ICP and the residual elemental content of aluminum was about 764 ppm, about 32 ppm of calcium, about 21 ppm of copper, about 0 ppm of iron, about 271 ppm of sodium and about 0 ppm of silicon.

Example 15

Preparation of Toner Particles O—Latex Series Tg=59.6° C.

EA particles were prepared by mixing together about 190 grams of High Tg Latex C having a solids loading of about 41.7 weight percent and a glass transition temperature of about 59.6° C., about 65.89 grains of Wax Emulsion A having a solids loading of about 30.80 weight percent, about 90.27 grams of black pigment dispersion Cavitron PD-K24 (Regal 330) having a solids loading of about 17.1 weight percent, about 72 grams of Gel Latex A having a solids content of about 25 weight percent with about 503.6 grams of deionized water in a vessel while being stirred using an IKA Ultra Turrax® T50 homogenizer operating at about 4,000 rpm.

After about 5 minutes of homogenizing, slow controlled addition of about 30.6 grams of a flocculent mixture containing about 3.06 grams poly(aluminum chloride) mixture and about 27.54 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 123.74 grams of High Tg Latex C was added and the particles grew to the target particle size of about 5.85 to about 5.90 microns. The particle size was frozen by adjusting the reactor mixture pH to about 6.0 with about 1 molar sodium hydroxide solution. Thereafter, the reactor mixture was heated at about 1° C. per minute to a temperature of about 85° C., followed by adjusting the reactor mixture pH to about 3.9 with about 0.3 M nitric acid solution. The reaction mixture was then ramped to about 96° C. at about 0.5° C. per minute.

At the start of particle coalescence the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of 5 hours at about 96° C. The particles were cooled at a control rate of about 0.6° C. per minute to about 85° C. and then fast cooled to about 63° C. At about 63° C., the slurry was treated with about 4 percent sodium hydroxide solution to a pH of about 10 for about 10 minutes followed by cooling to about room temperature.

The toner of this mixture comprised about 71 percent of styrene/acrylate polymer, about 8 percent of Regal 330-pigment, about 11 percent by weight of Wax Emulsion A and about 10 percent by weight of Gel Latex A.

The particles were washed about 5 times after removal of the mother, followed by about 3 washes with deionized water at about room temperature, one wash carried out at a pH of about 4.0 at about 40° C., and finally the last wash with deionized water at about room temperature.

After drying the particles in an Aljet dryer, the final volume median particle size D50 of about 5.48 microns, (GSDv of about 1.21, GSDn of about 1.25, percent fines (< 4.0 microns) of about 16.2%, particle circularity of about 0.965, particle onset Tg of about 53.9° C., particle weight average molecular weight Mw of about 39,500, measured carbon black content of about 8.4 weight percent by TGA and measured wax content of about 9.7 weight percent by DSC. Various elements were analyzed by TCP and the residual elemental content of aluminum was about 764 ppm, about 34 ppm of calcium, about 29 ppm of copper, about 4 ppm of iron, about 240 ppm of sodium and about 4 ppm of silicon.

Example 16

Preparation of Toner Particles P—Latex Series Tg=61.1° C.

EA particles were prepared by mixing together about 187.8 grams of High Tg Latex D having a solids loading of about 42.2 weight percent and a glass transition temperature of about 61.1° C., about 65.89 grams of Wax Emulsion having a solids loading of about 30.80 weight percent, about 90.27 grains of black pigment dispersion Cavitron PD-K24 (Regal 330) having a solids loading of about 17.1 weight percent, about 72 grams of Gel Latex A having a solids content of about 25 weight percent with about 505.8 grams of deionized water in a vessel while being stirred using an RCA Ultra Turrax® T50 homogenizer operating at about 4,000 rpm.

After about 5 minutes of homogenizing, slow controlled addition of about 30.6 grams of a flocculent mixture containing about 3.06 grams poly(aluminum chloride) mixture and about 27.54 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, an additional about 122.37 grams of High Tg Latex D was added and the particles grew to the target particle size of about 5.85 to about 5.90 microns. The particle size was frozen by adjusting the reactor mixture pH to 6.0 with 1 molar sodium hydroxide solution.

Thereafter, the reactor mixture was heated at about 1° C. per minute to a temperature of about 85° C., followed by adjusting the reactor mixture pH to about 3.9 with about 0.3 M nitric acid solution. The reaction mixture was then ramped to about 96° C. at about 0.5° C. per minute.

At the start of particle coalescence the pH was checked but not adjusted. The particle shape was monitored by measuring particle circularity using the Sysmex FPLA shape analyzer. Once the target circularity of about 0.958 was achieved, the pH was adjusted to about 7.0 with about 1 percent sodium hydroxide solution. Particle coalescence was continued for a total of about 5 hours at about 96° C. The particles are cooled at a control rate of about 0.6° C. per minute to about 85° C. and then fast cooled to about 63° C. At about 63° C., the slurry was treated with about 4 percent sodium hydroxide solution to a pH of about 10 for about 10 minutes followed by cooling to about room temperature.

The toner of this mixture comprised about 71 percent of styrene/acrylate polymer, about 8 percent of Regal 330 pigment, about 11 percent by weight of Wax Emulsion A and about 10 percent by weight of Gel Latex A.

The particles were washed about 5 times after removal of the mother liquor, followed by about 3 washes with deionized water at about room temperature, one wash carried out at a pH of about 4.0 at about 40° C., and finally the last wash with deionized water at about room temperature.

After drying the particles in an Aljet dryer, the final volume median particle size D50 of about 5.54 microns, GSDv of about 1.221, GSDn of about 1.25, percent fines (< 4.0 microns) of about 15.7%, particle circularity of about 0.966, onset Tg of about 54.3° C., particle weight average molecular weight Mw of about 36,600, measured carbon black content of about 8.0 weight percent by TGA and measured wax content of about 9.3 weight percent by DSC. Various elements were analyzed by ICP and the residual elemental content of aluminum was about 824 ppm, about 32 ppm of calcium, about 14 ppm of copper, about 0 ppm of iron, about 246 ppm of sodium and about 296 ppm of silicon.

TABLE 3

Latitude Study of POLYWAX 655 in EA Particle Formulation

| Example | Wax Input Loading |
|---|---|
| 17 | 10.50% |
| 18 | 11% |
| 19 | 11.50% |

Example 17

Preparation of Toner Particles Q with 10.5% Polywax 655

EA particles were prepared by mixing together about 10.7134 kilograms of High Tg Latex A having a solids loading of about 41.57 weight percent, 3.47177 kilograms of Wax Emulsion B having a solids loading of about 31.00 weight percent, about 5.04471 kilograms of black pigment dispersion Cavitron PD-K162/163 (Regal 330) having a solids loading of about 17.0 weight percent, about 4.0 kilograms of Gel Latex B having a solids content of about 25 weight percent with about 32.0483 kilograms of deionized water in a vessel while being stinted using an IKA Ultra Turrax® T50 homogenizer operating about 4,000 rpm.

After about 30 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Layson Cell. Upon reaching about 4.8 microns, an about additional 6.89598 kilograms of High Tg Latex A was added and the particles grew to the target particle size of about 5.85 to about 5.90 microns. The particle size was frozen by adjusting the reactor mixture pH to about 6.0 with about 1 molar sodium hydroxide solution.

Thereafter, the reactor mixture was heated at about 0.35° C. per minute to a temperature of about 85° C., followed by adjusting the reactor mixture pH to about 3.9 with about 0.3

M nitric acid solution. The reaction mixture was then ramped to about 96° C. at about 0.35° C. per minute.

At the start of particle coalescence, the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 2.5 hours at about 96° C. The particles were cooled at a control rate of about 0.46° C. per minute to about 85° C. and then fast cooled to about 63° C. At about 63° C., the slurry was treated with about 4 percent sodium hydroxide solution to pH of about 10 for about 20 minutes followed by cooling to about room temperature.

The toner of this mixture comprised about 71.5 percent of styrene/acrylate polymer, about 8 percent of Regal 330 pigment, about 10.5 percent by weight of Wax Emulsion B and about 10 percent by weight of Gel Latex B.

The particles were washed 3 times after removal of the mother liquor consisting of 1 wash with deionized water at about room temperature, one wash carried out at a pH of about 4.0 at about 40° C., and finally the last wash with deionized water at about room temperature. The amount of acid used for the pH of about 4 wash was about 300 grams of about 0.3 molar nitric acid.

After drying the particles in an Aljet dryer, the final volume median particle size D50 of about 5.82 microns, GSDv of about 1.20, GSDn of about 1.28, percent fines (<4.0 microns) of about 15.74%, and a particle circularity of about 0.966.

Example 18

Preparation of Toner Particles R with 11.0% Polywax 655

EA particles were prepared by mixing together about 10.5903 kilograms of High Tg Wax A having a solids loading of about 41.57 weight percent, about 3.6371 kilograms of Wax Emulsion B having a solids loading of about 31.00 weight percent, about 5.04471 kilograms of black pigment dispersion Cavitron PD K223/K229 (Regal 330) having a solids loading of about 17.0 weight percent, about 4.0 kilograms of Gel Latex B having a solids content of about 25 weight percent with about 32.0066 kilograms of deionized water in a vessel while being stirred using an IKA Ultra Turrax® T50 homogenizer operating at about 4,000 rpm.

After about 30 minutes, of homogenizing slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of 4.8 micron as measured with a Layson Cell. Upon reaching about 4.8 microns, an about additional 6.89598 kilograms of High Tg Latex A was added and the particles grew to the target particle size of about 5.85 to about 5.90 microns. The particle size was frozen by adjusting the reactor mixture pH to about 6.0 with about 1 molar sodium hydroxide solution.

Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute.

At the start of particle coalescence the pH was checked but not adjusted. The particle shape was monitored by measuring particle circularity using the Sysmex EPIA shape analyzer. Once the target circularity of about 0.958 was achieved, the pH was adjusted to about 7.0 with about 1 percent sodium hydroxide solution. Particle coalescence was continued for a total of about 2.5 hours at about 96° C. The particles are cooled at a control rate of about 0.45° C. per minute to about 85° C. and then fast cooled to about 63° C. At about 63° C., the slurry was treated with about 4 percent sodium hydroxide solution to pH of about 10 for about 20 minutes followed by cooling to about room temperature.

The toner of this mixture comprised about 71 percent of styrene/acrylate polymer about 8 percent of Regal 330 pigment, about 1 percent by weight of Wax Emulsion B and about 12 percent by weight of Gel Latex B.

The particles were washed 3 times after removal of the mother liquor consisting of 1 wash with deionized water at room temperature, one wash carried out at a pH of about 4.0 at about 40° C., and finally the last wash with deionized water at room temperature.

The amount of acid used for the pH 4 wash was 300 grams of 0.3 molar nitric acid. After drying the particles in an Aljet dryer the final volume median particle size D50 of about 5.74 microns, GSD by volume of about 1.20, GSD by number of about 1.27, percent fines (<4.0 microns) of about 16.19%, particle circularity of about 0.962.

Example 19

Preparation of Toner Particles S with 11.5% Polywax 655

EA particles were prepared by mixing together about 10.4671 kilograms of High Tg Latex A having a solids loading of about 41.57 weight percent, about 3.80242 kilograms of Wax Emulsion B having a solids loading of about 31.00 weight percent, about 5.04471 kilograms of black pigment dispersion Cavitron PD-K171/K179 (Regal 330) having a solids loading of about 17.0 weight percent, about 4.0 kilograms of Gel Latex B having a solids content of about 25 weight percent with about 31.9649 kilograms of deionized water in a vessel while being stirred using an IKA Ultra Turrax® T50 homogenizer operating at about 4,000 rpm.

After about 5 minutes of homogenizing, slow controlled addition of about 1.7 kilograms of a flocculent mixture containing about 170 grams poly(aluminum chloride) mixture and about 1530 grams of about 0.02 molar nitric acid solution was performed. The reactor jacket temperature was set to about 57° C. and the particles aggregated to a target size of about 4.8 micron as measured with a Coulter Counter. Upon reaching about 4.8 microns, about an additional 6.89598 kilograms of High Tg Latex A was added and the particles grew to the target particle size of about 5.85 to about 5.90 microns. The particle size was frozen by adjusting the reactor mixture pH to about 6.0 with about 1 molar sodium hydroxide solution.

Thereafter, the reactor mixture was heated at about 0.35° C. per minute to a temperature of about 85° C., followed by adjusting the reactor mixture pH to about 3.9 with about 0.3 M nitric acid solution. The reaction mixture was then ramped to about 96° C. at about 0.35° C. per minute. At the start of particle coalescence the pH was checked but not adjusted. The particle shape was monitored by measuring particle circularity using the Sysmex FPIA shape analyzer. Once the target circularity of about 0.958 was achieved, the pH was adjusted to about 7.0 with about 1 percent sodium hydroxide solution. Particle coalescence was continued for a total of about 2.5 hours at about 96° C. The particles were cooled at a control rate of about 0.46° C. per minute to about 85° C. and then fast cooled to about 63° C. At about 63° C., the slurry was treated with about 4 percent sodium hydroxide solution to pH of about 10 for about 20 minutes followed by cooling to about room temperature.

The toner of this mixture comprised about 70.5 percent of styrene/acrylate polymer, about 8 percent of Regal 330 pigment, about 11.5 percent by weight of Wax Emulsion B and about 10 percent by weight of Gel Latex B.

The particles were washed 3 times after removal of the mother liquor consisting of 1 wash with deionized water at about room temperature, one wash carried out at a pH of about 4.0 at about 40° C., and finally the last wash with deionized water at room temperature. The amount of acid used for the pH 4 wash was about 300 grams of about 0.3 molar nitric acid.

After drying the particles in an Aljet dryer, the final volume median particle size D50 of about 5.84 microns, GSDv of about 1.20, GSDn of about 1.29, percent fines (<4.0 microns) of about 16.69%, particle circularity of about 0.965.

The solid area lightness L* was about 23 at the target developed toner mass per unit area (TMA) of about 0.45 $mg/cm^2$. The specification for solid area mottle was less than about 60 at the target TMA of about 0.45 $mg/cm^2$ and this was achieved for toners within the particle formulation latitude design space. The solid area mottle as a function of L* showed a minimum variation in mottle (specification of less than about 60 units) as a function of L* for all toners.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A toner composition having toner particles comprising:

a gel latex, a high Tg latex having a Tg from about 57° C. to about 62° C., a polyethylene wax having a Mn of 655 to 725, and a colorant, wherein the gel latex is present in an amount of from about 3 weight percent to about 30 weight percent of the toner composition, the high Tg latex is present in an amount of from about 67 weight percent to about 75 weight percent of the toner composition, the polyethylene wax is present in an amount of from about 10 weight percent to about 12 weight percent of the toner composition, and the colorant is present in an amount of from about 1 weight percent to about 25 weight percent of the toner composition.

2. The toner composition according to claim 1, wherein a latitude of the gel latex around about a centerline particle formulation is about 10 weight percent±about 2 weight percent.

3. The toner composition according to claim 1, wherein a latitude of the colorant around about a centerline particle formulation is about 8 weight percent±about 1.0 weight percent.

4. The toner composition according to claim 1, wherein a crosslinked density of the gel latex is from about 0.3 to about 40, and a crosslinked density of the high Tg latex is less than about 0.1.

5. The toner composition according to claim 1, wherein a circularity of the toner particles is from about 0.95 to about 1.0.

6. The toner composition according to claim 1, wherein D50 of the toner particles is in a range of from about 5.45 to about 5.88.

7. The toner composition according to claim 1, wherein GSDv of the toner particles is in a range of from about 1.15 to about 1.25.

8. The toner composition according to claim 1, wherein GSDn of the toner particles is in a range of from about 1.20 to about 1.30.

9. The toner composition according to claim 1, wherein the toner particles are emulsion/aggregation toner particles.

10. The toner composition according to claim 1, wherein the wax is an aliphatic wax, a polyethylene, a polypropylene, or mixtures thereof.

11. The toner composition according to claim 1, wherein the gel latex comprises from about 30 weight percent to about 99.9 weight percent styrene, from about 5 weight percent to about 50 weight percent butyl acrylate, from about 0.05 weight percent to about 15 weight percent of a carboxyl acid group containing monomer, and 0.25 weight percent to about 10 weight percent crosslinking agent.

12. The toner composition according to claim 1, wherein the high Tg latex is selected from the group consisting of styrene acrylates, styrene methacrylates, butadienes, isoprene, acrylonitrile, acrylic acid, methacrylic acid, beta-carboxyethylacrylate, polyesters, poly(styrene-butadiene), poly(methyl styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methyl styrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), and styrene/butyl acrylate/carboxylic acid terpolymers, styrene/butyl acrylate/beta-carboxyethylacrylate terpolymers, and mixtures thereof.

13. The toner composition according to claim 1, wherein the toner particles further comprise a flocculant, wherein a latitude of the flocculant around about a centerline particle formulation is about 0.17 weight percent±about 0.02 weight percent.

14. A developer comprising:

the toner composition according to claim 1; and a carrier, wherein the developer is used in a conductive magnetic brush development system.

15. A toner process comprising:

mixing gel latex, a high Tg latex having a Tg from about 57° C. to about 62° C., a polyethylene wax having a Mn of 655 to 725 and a colorant to provide toner size aggregates;

heating the aggregates to form the toner; and optionally, isolating the toner, wherein the gel latex is present in an amount of from about 3 weight percent to about 30 weight percent of the toner, the high Tg latex is present in an amount of from about 67 weight percent to about 75 weight percent of the toner, the wax is present in an amount of from about 10 weight percent to about 12 weight percent of the toner, and the colorant is present in an amount of from about 1 weight percent to about 25 weight percent of the toner.

16. The toner process according to claim 15, wherein a latitude of the gel latex around about a centerline particle formulation is about 10 weight percent±about 2 weight percent, a latitude of the high Tg latex around about a centerline particle formulation is about 71 weight percent±about 4 weight percent, a latitude of the wax around about a centerline particle formulation is about 11 weight percent±about 1 weight percent, and a latitude of the colorant around about a centerline particle formulation is about 8 weight percent±about 1.0 weight percent.

17. The toner process according to claim 15, wherein the mixing further includes mixing a flocculant with the gel latex, the high Tg latex, the wax and the colorant, wherein a latitude of the flocculant around about a centerline particle formulation is about 0.17 weight percent±about 0.02 weight percent.

18. The toner process according to claim 15, wherein a crosslinked density of the gel latex is from about 0.3 to about 40, and a crosslinked density of the high Tg latex is less than about 0.1.

19. A method of developing an image, comprising:

applying a toner composition to a substrate to form an image, the toner composition comprising a gel latex, a high Tg latex having a Tg from about 57° C. to about 62° C., a polyethylene wax having a Mn of 655 to 725, and a colorant, and fusing the toner composition to the substrate, wherein the gel latex is present in an amount of from about 3 weight percent to about 30 weight percent of the toner composition, the high Tg latex is present in an amount of from about 67 weight percent to about 75 weight percent of the toner composition, the wax is present in an amount of from about 10 weight percent to about 12 weight percent of the toner composition, and the colorant is present in an amount of from about 1 weight percent to about 25 weight percent of the toner composition.

* * * * *